US008215486B2

(12) United States Patent
Sanders et al.

(10) Patent No.: US 8,215,486 B2
(45) **Date of Patent: *Jul. 10, 2012**

(54) PACKAGE OF STACKED PAPER PRODUCTS BEARING COORDINATED IMAGES

(75) Inventors: Cathy Marie Sanders, Cleves, OH (US); Phillip Lacoi Hutchison, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/232,084

(22) Filed: Sep. 14, 2011

(65) Prior Publication Data

US 2012/0000919 A1 Jan. 5, 2012

Related U.S. Application Data

(63) Continuation of application No. 12/425,687, filed on Apr. 17, 2009, now Pat. No. 8,038,007.

(51) Int. Cl.
*B65D 85/00* (2006.01)
*B65D 73/00* (2006.01)

(52) U.S. Cl. ..... 206/494; 206/459.5

(58) Field of Classification Search ..... 206/215, 206/233, 449, 459.5, 494, 497, 499, 812; 162/134; 221/34; 270/32, 42, 52.03
See application file for complete search history.

(56) References Cited

U.S. PATENT DOCUMENTS

| | | | |
|---|---|---|---|
| 1,909,407 | A | 5/1933 | Hudson |
| 2,111,723 | A | 3/1938 | Perkins |
| 2,141,752 | A | 12/1938 | Hoarle |
| 2,607,594 | A | 8/1952 | Rubinoff |
| 3,595,382 | A | 7/1971 | Hofer |
| 3,842,974 | A | 10/1974 | Jacobsen |
| 4,177,898 | A | 12/1979 | Humphrey |
| 6,061,938 | A | 5/2000 | Young |
| 6,393,743 | B1 | 5/2002 | Whitworth |
| 6,520,330 | B1 | 2/2003 | Batra |
| 6,682,063 | B2 | 1/2004 | Niedermeyer |
| 7,527,152 | B2 | 5/2009 | Lentner et al. |
| 2004/0094278 | A1 | 5/2004 | Wong |

OTHER PUBLICATIONS

Digital photos of Bounty 180 One-Ply Quilted Napkins—Signature Series ©2008.
All Office Actions for U.S. Appl. No. 12/425,687.

*Primary Examiner* — Bryon Gehman
(74) *Attorney, Agent, or Firm* — Christian M. Best

(57) ABSTRACT

A package of two or more stacks of paper sheet products, such as paper napkins or paper towels is disclosed. Each of the paper sheet products is printed with at least a first motif image and a second motif image. An uppermost paper sheet product of one of the stacks displays the first motif image and an uppermost paper sheet product of another of the stacks displays the second motif image. The napkins may be folded in each stack such that the exposed image of each napkin in a given stack alternates between the first motif image and the second motif image. The first and second images may be motif images that are thematically related to one another, in that both the motif images are primarily associated with the same event, holiday, season or special occasion.

20 Claims, 4 Drawing Sheets

PACKAGE OF STACKED PAPER PRODUCTS BEARING COORDINATED IMAGES

CROSS REFERENCE TO RELATED APPLICATIONS

This application is a continuation of U.S. application Ser. No. 12/425,687, filed on Apr. 17, 2009, now U.S. Pat. No. 8,038,007, issued on Oct. 18, 2011, the entire disclosure of which is fully incorporated by reference herein.

FIELD OF THE INVENTION

This disclosure relates generally to packaged paper goods. More specifically, this disclosure relates to the provision of correlated and/or coordinated image-bearing paper sheet products, such as paper napkins or paper towels, in packages including at least a pair of stacks of the paper sheet products.

BACKGROUND OF THE INVENTION

Paper napkins are known to be used for a wide variety of informal events, such as dining, sporting events, birthday and holiday parties, barbecues, picnics, celebrations of other life milestones, as well as other special occasions. Paper napkins with images that are associated with particular events printed thereon are known. Paper napkins bearing such images contribute to the décor of the events and are found to be highly desired by consumers. Paper napkins are often sold in pairs of stacks of napkins enclosed in substantially transparent packaging material. While the packaging material may itself include brand identifiers, graphics, or other printing thereon, at least a portion of the top (or uppermost) napkin of each stack is typically visible through the packaging material.

It would be desirable to package paper napkins bearing images associated with particular events in a manner that increases consumer appeal over existing packages of printed paper napkins.

SUMMARY OF THE INVENTION

While it is known to provide a package of image-bearing paper napkins in the form of at least two stacks of napkins enclosed in substantially transparent packaging material, the consumer appeal of such packaged napkins can be improved by providing individual napkins with a plurality of images disposed upon various quadrants of the napkin. The embodiments of the present disclosure can preferably employ distinct, but thematically related images printed on various quadrants of a paper sheet product, such as a paper napkin. The napkin may be folded in a first manner, such that a first of the images is visible on an exposed surface of the napkin, or in a second manner, such that a second of the images is visible on an exposed surface of the napkin. The stacks of napkins in a given package can be preferably arranged so that a napkin folded in the first manner can be provided as the uppermost napkin of one of the stacks in the package as-wrapped for delivery and retail display, and a napkin folded in the second manner can be provided as the uppermost napkin of another of the stacks. Alternatively, stacks of napkins in a given package can be preferably arranged so that a napkin folded in the first manner is provided as the uppermost napkin of one of the stacks in the package as-wrapped for delivery and retail display, and a napkin folded in the first manner may be provided as the uppermost napkin of another of the stacks.

As used herein, the term "thematically related" refers to images that share a common theme, in that each of the images has relevance to the same subject matter. By way of non-limiting example, images are considered to be thematically related where the images are primarily associated by a viewer with the same event, holiday, season, or occasion.

As used herein, the term "motif image" refers to a printed image that is capable of connoting a theme to a viewer, in that it depicts something, such as one or more items or objects, that a viewer commonly associates with an event, holiday, season, or occasion.

Packages of printed paper sheet products other than paper napkins are also within the scope of the present disclosure. For example, a pair of stacks of paper towels may be provided in a single wrapped package, wherein opposite surfaces of each of the paper towels are printed with different images. The paper towels may be stacked in the package such that the paper towel on the top of a first of the pair of stacks is oriented with a surface displaying a first image exposed, and the paper towel on the top of a second of the pair of stacks is oriented with a surface displaying a second image exposed. The first and second images are preferably thematically related to one another.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF THE INVENTION

Figure 1:
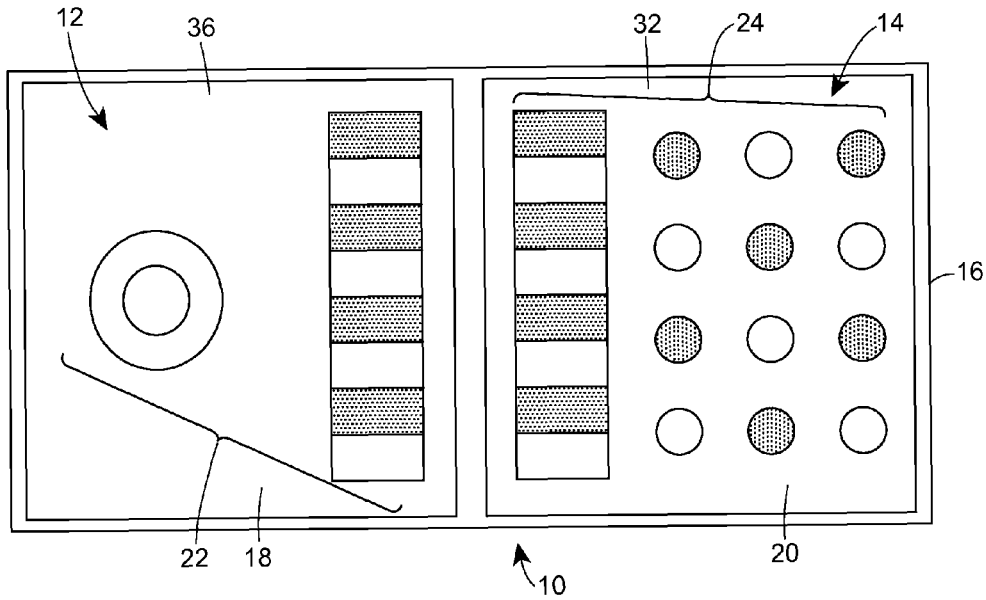
FIG. 1 is a top plan view of an exemplary wrapped package of two stacks of image-bearing paper products.
Figure 2:
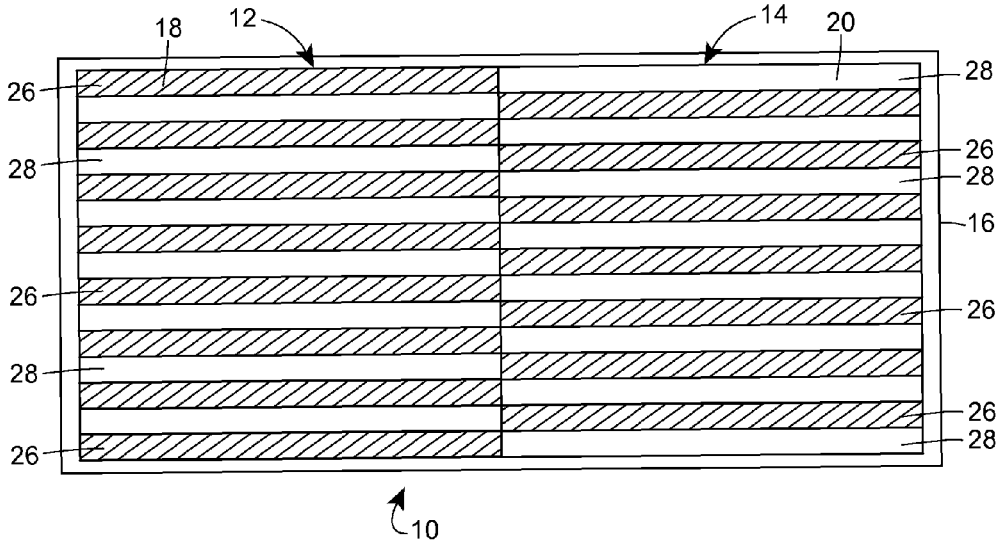
FIG. 2 is a schematic side view of the wrapped package of FIG. 1, wherein shaded blocks indicate paper products having an orientation in which a first image is facing upward and un-shaded blocks indicate paper products having an orientation in which a second image is facing upward.

A package 10 of image-bearing paper products is illustrated in FIGS. 1 and 2. The image-bearing paper products may, by way of non-limiting example only, be paper napkins or paper towels. The package 10 includes at least a first stack 12 and a second stack 14 of the image-bearing paper products, both enclosed by a substantially transparent packaging material 16. While the packaging material 16 may include product identifying information or other graphics thereon, at least a portion of an exposed surface of uppermost sheets 18, 20 of each stack 12, 14 is visible through the substantially transparent packaging material 16.

Each of the uppermost sheets 18, 20 bears at least a first image 22 and a second image 24 thereupon. Preferably, only one of the first image 22 or the second image 24 is printed on the exposed surface of the uppermost sheet 18, and only the other of the first or the second image 24 is printed on the exposed surface of the uppermost sheet 20.

As illustrated schematically in FIG. 2, shaded blocks 26 indicate paper products having an orientation in which the first image 22 is facing outward and un-shaded blocks 28 indicate paper products having an orientation in which the second image 24 is facing outward. Thus, the paper products of the first stack 12 may be arranged in alternating orientations, and the paper products of the second stack 14 may likewise be arranged in alternating orientations.

Figure 3:
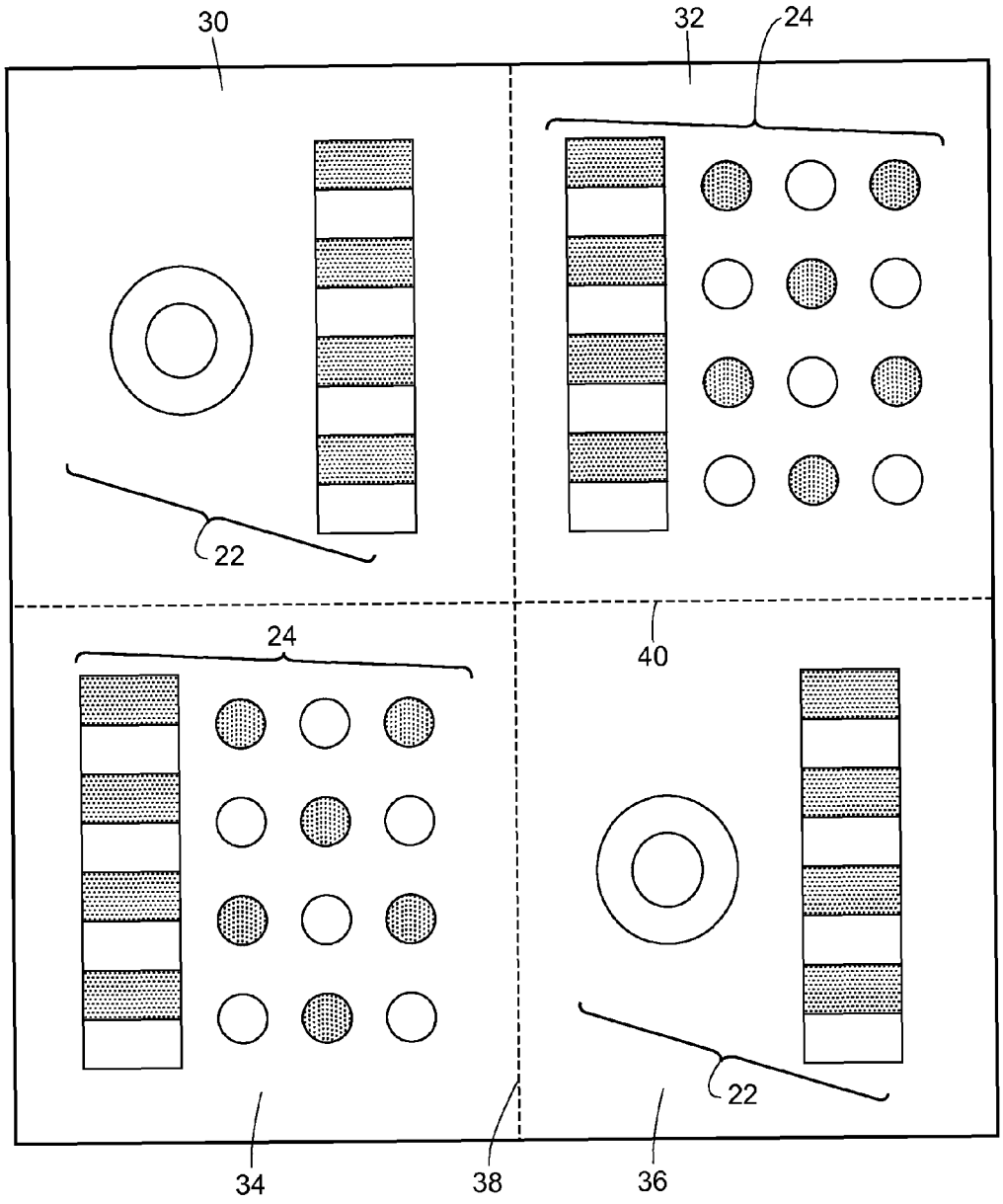
FIG. 3 is a plan view of an exemplary paper napkin having a machine direction fold and a cross-machine direction fold dividing the paper napkin into four quadrants, and alternate quadrants bear alternate images.

In the case of a paper napkin, as illustrated in FIG. 3, the first image 22 and second image 24 may both be printed on the same face of the napkin, provided that when folded into sections, such as quadrants 30, 32, 34, 36, only one of the first image 22 or the second image 24 is visible on the exposed quadrant, such as quadrant 32 or 36 of the napkin. Each of the quadrants 30, 32, 34, and 36 may comprise, may be defined by, or may be outlined by a perimeter. The first and second images 22 and 24 within the various quadrants 30, 32, 34, and 36 may be spatially separated from the perimeters of the various quadrants 30, 32, 34, and 36. For example, referring to FIG. 3, the first image 22 within the quadrant 30 may be spatially separated from the perimeter of the quadrant 30. The napkin includes a longitudinal crease along which the napkin is to be folded. In mass-produced, machine-folded paper napkins, this longitudinal crease is formed in the direction of travel of the product through any manufacturing equipment. This direction of travel is known to those of skill in the art as the machine direction. This resulting fold is referred to hereinafter as the machine direction fold, or simply MD fold 38. The napkin may further include a crease running perpendicular and co-planar to the longitudinal crease or MD fold 38. This direction is known to those of skill in the art as the cross-machine direction. This resulting fold is referred to hereinafter as the cross-machine direction fold or CD fold 40. The MD fold 38 and the CD fold 40 divide the napkin into four contiguous quadrants 30, 32, 34, 36.

Typically, machine-folded paper napkins are first folded along the MD fold 38, and then along the CD fold 40. However, it is envisioned that machine-folded paper napkins can be first folded along the CD fold 40 and then along the MD fold 38. In any case, the first and second images 22 and 24 may be printed on opposite sides of the MD fold 38 from one another, and on opposite sides of the CD fold 40 from one another, such that the first image 22 is printed on quadrants 30 and 36, and the second image 24 is printed on quadrants 32 and 34. As the machine-folded napkins are stacked and prepared for packaging, they may be stacked in an alternating manner as illustrated in FIG. 2, such that quadrant 36 is the exposed quadrant of the uppermost napkin 18 of the first stack 12, quadrant 32 would be the exposed quadrant of the next-lower napkin of the first stack 12 upon removal of the uppermost napkin 18, quadrant 36 is the exposed quadrant of the third napkin of the first stack 12 upon removal of the previous napkin of the first stack 12, and so on. In other words, counting from the uppermost napkin 18 of the first stack 12, the quadrant 36 of the napkin bearing the first image 22 of every second napkin faces outward, and counting from a napkin immediately below the uppermost napkin 18, the quadrant 32 of the napkin bearing the second image 24 faces outward. Expressed yet another way, quadrant 32 of an uppermost napkin would be provided in a face-to-face relationship with quadrant 36 of the next lower napkin of the first stack 12 and quadrant 36 of the second napkin would be in a face-to-face relationship with quadrant 32 of a the next succeeding napkin of the first stack 12, and so on.

Likewise, quadrant 32 is the exposed quadrant of the uppermost napkin 20 of the second stack 14, quadrant 36 would be the exposed quadrant of the next-lower napkin of the second stack 14 upon removal of the uppermost napkin 20 of the second stack 14, then quadrant 32 would be the exposed quadrant of the third napkin of the second stack 14 upon removal of the second napkin 20 of the second stack 14, and so on. In other words, counting from the uppermost napkin 20 of the second stack 14, the quadrant 32 of the napkin bearing the second image 24 of every second napkin faces outward, and counting from a napkin immediately below the uppermost napkin 20, the quadrant 36 of the napkin bearing the first image 22 of every second napkin faces outward. In this manner, when initially packaged in the packaging material 16, the consumer sees the uppermost napkin 18 of the first stack 12 bearing the first image 22, side-by-side with the uppermost napkin 20 of the second stack 14 bearing the second image 24. As the napkins of the stacks are removed for use, the image on the exposed surface of the next-revealed napkin alternates between the first image 22 and the second image 24.

Figure 4:
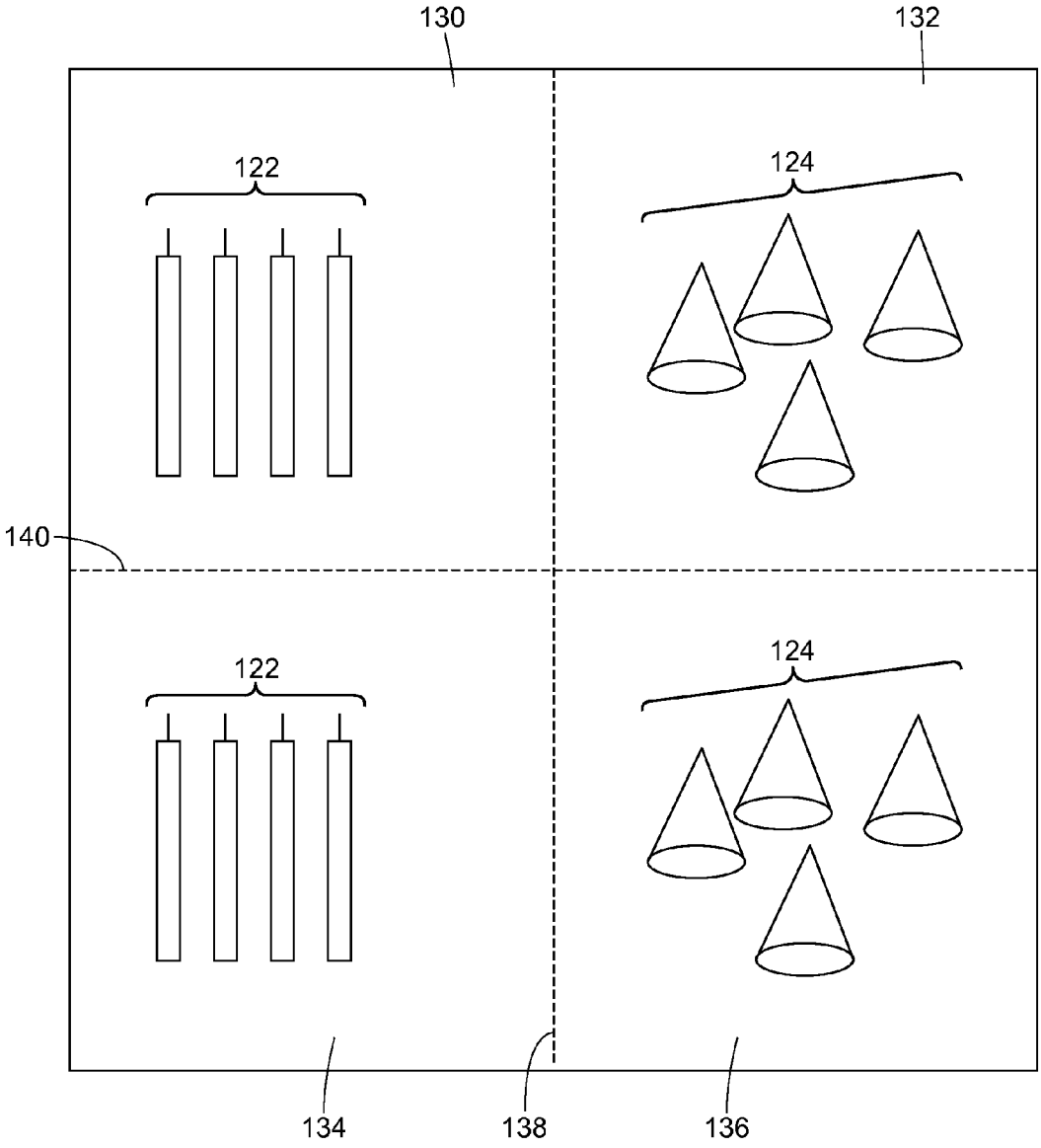
FIG. 4 is a plan view of yet another exemplary paper napkin having a machine direction fold and a cross-machine direction fold dividing the paper napkin into four quadrants, and wherein each of the quadrants on a first side of the machine direction fold bears a first motif image and each of the quadrants on a second side of the machine direction fold bears a second motif image, the first and second motif images being thematically related with one another.
Figure 5:
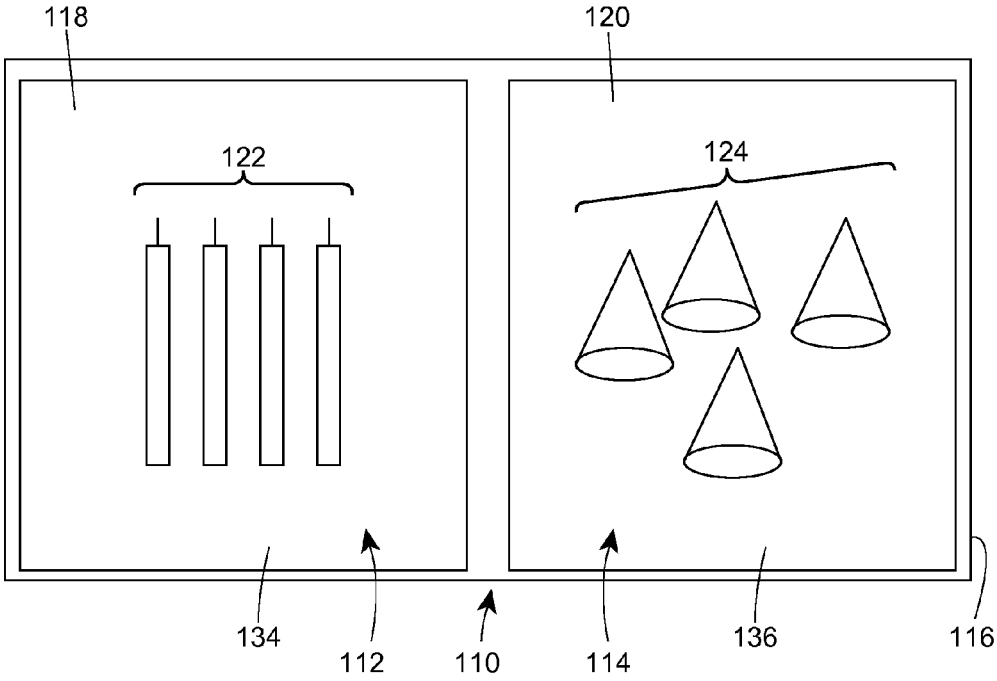
FIG. 5 is a top plan view of an exemplary wrapped package of two stacks of the thematically related motif image-bearing paper napkins of FIG. 4.

FIGS. 4 and 5 illustrate a paper sheet product in the form of a paper napkin for use in a package 110 of a second embodiment of the present disclosure. A first motif image 122 and a second motif image 124 disposed on the paper napkin illustrated in FIG. 4 are preferably thematically related to one another. In this non-limiting example, the first motif image 122 includes a plurality of birthday candles and the second motif image 124 includes a plurality of party hats. While the first motif image 122 and the second motif image 124 can be primarily associated by a viewer with birthday parties, it will be understood that there are a wide variety of events, holidays, seasons, or special occasions, such as (by way of example only): Halloween, Thanksgiving, Christmas, Hanukkah, Kwanzaa, Easter, New Years Eve, Summer, Winter, Autumn, Spring, graduation, anniversary, bridal showers, baby showers, or elections, to which coordinated pairs of motif images of paper sheet products may be associated and considered within the scope of this embodiment.

As with the napkins illustrated in FIGS. 1 and 3, napkins printed as illustrated in FIG. 4 may include an MD fold 138 and a CD fold 140. The first motif image 122 may be printed on quadrants on the same side of the MD fold 138, namely quadrants 130, 134, and the second motif image 124 may be printed on quadrants on the opposite side of the MD fold 138, namely quadrants 132, 136. It will be recognized that the first motif image 122 and second motif image 124 may instead be printed in alternating quadrants on opposite sides of both the MD fold 138 and the CD fold 140 from one another, i.e. reversing the order of the first motif image 122 and second motif image 124 in quadrants 134 and 136, similar to the arrangement of images 22, 24 in FIG. 3. In any event, each of the quadrants 130, 132, 134, and 136 may comprise, may be defined by, or may be outlined by a perimeter. The first and second motif images 124 and 126 within the various quadrants 130, 132, 134, and 136 may be spatially separated from the perimeters of the various quadrants 130, 132, 134, and 136. For example, referring to FIG. 4, the first motif image 122 within the quadrant 130 may be spatially separated from the perimeter of the quadrant 130. The napkins printed as illustrated in FIG. 4 may be folded and stacked for packaging such that an uppermost napkin 118 of a first stack 112 of the napkins has the first motif image 122 exposed, such as by being folded in a manner that the exposed quadrant of the napkin 118 is quadrant 134, and an uppermost napkin 120 of a second stack 114 of the napkins has the second motif image 124 exposed, such as by being folded in a manner that the exposed quadrant of the napkin 120 is quadrant 136.

Like the napkins illustrated in FIGS. 1 and 3, as the machine-folded printed napkins as illustrated in FIG. 4 are stacked and prepared for packaging, they may be stacked in an alternating manner as illustrated in FIG. 2, such that quadrant 136 is the exposed quadrant of the uppermost napkin 118 of the first stack 112, quadrant 134 is the exposed quadrant of the next-lower napkin of the first stack 112, quadrant 136 is the exposed quadrant of the third napkin of the first stack 112, and so on. In other words, counting from the uppermost napkin 118 of the first stack 112, the quadrant 134 of the napkin bearing the first motif image 122 of every second napkin faces upward, and counting from a napkin immediately below the uppermost napkin 118, the quadrant 136 of the napkin bearing the second motif image 124 of every second napkin faces upward.

Likewise, quadrant 134 is the exposed quadrant of the uppermost napkin 120 of the second stack 114, followed by quadrant 136 being the exposed quadrant of the next-lower napkin of the second stack 114, then quadrant 134 is the exposed quadrant of the third napkin of the second stack 114, and so on. In other words, counting from the uppermost napkin 120 of the second stack 114, the quadrant 136 of the napkin bearing the second motif image 124 of every second napkin faces upward, and counting from a napkin immediately below the uppermost napkin 120, the quadrant 134 of the napkin bearing the first motif image 122 of every second napkin faces upward. In this manner, when initially packaged in substantially transparent packaging material 116, consumers see the uppermost napkin 118 of the first stack 112 bearing the first motif image 122, side-by-side with the uppermost napkin 120 of the second stack 114 bearing the second motif image 124. As the napkins of the respective first and second stacks 112, 114 are removed for use, the motif image on the exposed surface of the next-revealed napkin alternates between the first motif image 122 and the second motif image 124.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Any dimensions and values disclosed herein are not to be understood as being strictly limited to the exact value recited. Instead, unless otherwise specified, each such dimension or value is intended to mean both the recited value and a functionally equivalent range surrounding that dimension or value. For example, a dimension disclosed as "40 mm" is intended to mean "about 40 mm."

What is claimed is:

1. A package of napkin or paper towel sheets, the package comprising:

a plurality of stacked first sheets;

a plurality of stacked second sheets; and a packaging material enclosing the plurality of stacked first sheets and the plurality of stacked second sheets;

wherein each of the first and second stacked sheets comprises:

a first quadrant comprising:

a first image; and a first perimeter surrounding the first quadrant, wherein the first image and any other images within the first quadrant are spatially separated from the first perimeter;

a second quadrant comprising:

a second image; and a second perimeter surrounding the second quadrant, wherein the second image and any other images within the second quadrant are spatially separated from the second perimeter;

a third quadrant comprising:

the first image; and a third perimeter surrounding the third quadrant, wherein the first image and any other images within the third quadrant are spatially separated from the third perimeter; and a fourth quadrant comprising:

the second image; and a fourth perimeter surrounding the fourth quadrant, wherein the second image and any other images within the fourth quadrant are spatially separated from the fourth perimeter.

2. The package of claim 1, wherein an uppermost one sheet of the plurality of stacked first sheets is arranged when the first sheets are folded about a first fold line and a second fold line such that at least a portion of the first image is visible through the packaging material and the uppermost one sheet of the plurality of stacked second sheets is arranged when the second sheets are folded about a first fold line and a second fold line such that at least a portion of the second image is visible through the packaging material.

3. The package of claim 2, wherein, for each of the first and second stacked sheets, the first quadrant is positioned across the first fold line from the third quadrant.

4. The package of claim 3, wherein, for each of the first and second stacked sheets, the first quadrant is positioned across the second fold line from the third quadrant.

5. The package of claim 2, wherein, for each of the first and second stacked sheets, the second quadrant is positioned across the first fold line from the fourth quadrant.

6. The package of claim 5, wherein, for each of the first and second stacked sheets, the second quadrant is positioned across the second fold line from the fourth quadrant.

7. A package of paper sheets, the package comprising:

a plurality of stacked first sheets;

a plurality of stacked second sheets, each of the first and second stacked sheets comprising:

a first quadrant defined by a first perimeter and comprising a first image, wherein the first image and any other images within the first quadrant are spatially separated from the first perimeter;

a second quadrant defined by a second perimeter and comprising a second image, wherein the second image and any other images within the second quadrant are spatially separated from the second perimeter;

a third quadrant defined by a third perimeter and comprising the first image, wherein the first image and any other images within the third quadrant are spatially separated from the third perimeter; and a fourth quadrant defined by a fourth perimeter and comprising the second image, wherein the second image and any other images within the fourth quadrant are spatially separated from the fourth perimeter; and a packaging material enclosing the plurality of stacked first sheets and the plurality of stacked second sheets.

8. The package of claim 7, wherein each of the first and second stacked sheets comprises:

a first fold line separating two of the quadrants from the other two of the quadrants; and a second fold line separating two of the quadrants from the other two of the quadrants.

9. The package of claim 8, wherein a portion of the first perimeter and a portion of the second perimeter are positioned on the first fold line and the second fold line, and wherein a portion of the third perimeter and a portion of the fourth perimeter are positioned on the first fold line and the second fold line.

10. The package of claim 8, wherein neither the first image nor the second image crosses or touches the first fold line or the second fold line.

11. A package of paper sheets, the package comprising:

a plurality of stacked first sheets;

a plurality of stacked second sheets; and a packaging material enclosing the plurality of stacked first sheets and the plurality of stacked second sheets;

wherein each of the first and second stacked sheets comprises:

a first quadrant outlined by a first perimeter and comprising a first image, wherein the first image and any other images within the first quadrant are spatially separated from the first perimeter;

a second quadrant outlined by a second perimeter and comprising a second image, wherein the second image and any other images within the second quadrant are spatially separated from the second perimeter;

a third quadrant outlined by a third perimeter and comprising the first image, wherein the first image and any other images within the third quadrant are spatially separated from the third perimeter; and a fourth quadrant outlined by a fourth perimeter and comprising the second image, wherein the second image and any other images within the fourth quadrant are spatially separated from the fourth perimeter.

12. The package of claim 11, wherein each of the first and second sheets comprises:

a first fold line separating two of the quadrants from the other two of the quadrants; and a second fold line separating two of the quadrants from the other two of the quadrants.

13. The package of claim 12, wherein a portion of the first perimeter and a portion of the second perimeter define a portion of the first fold line and a portion of the second fold line.

14. The package of claim 12, wherein neither of the first image or the second image crosses or touches the first fold line or the second fold line.

15. The package of claim 12, wherein, for each of the first and second stacked sheets, the first quadrant is positioned across the first fold line from the third quadrant.

16. The package of claim 12, wherein, for each of the first and second stacked sheets, the first quadrant is positioned across the second fold line from the third quadrant.

17. The package of claim 12, wherein, for each of the first and second stacked sheets, the second quadrant is positioned across the first fold line from the fourth quadrant.

18. The package of claim 12, wherein, for each of the first and second stacked sheets, the second quadrant is positioned across the second fold line from the fourth quadrant.

19. The package of claim 11, wherein within the plurality of stacked first sheets, the stacked first sheets are arranged in an alternating manner, such that counting from the uppermost of the stacked first sheets, a first surface of every second sheet faces upward, and counting from a sheet immediately below the uppermost of the stacked first sheets, a second surface of every second sheet faces upward, and wherein within the plurality of stacked second sheets, the stacked second sheets are arranged in an alternating manner, such that counting from the uppermost of the stacked second sheets, a second surface of every second sheet faces upward, and counting from a sheet immediately below the uppermost of the stacked second sheets, a first surface of every second sheet faces upward.

20. The package of claim 11, wherein the packaging material comprises a substantially transparent portion.

* * * * *